US005155308A

United States Patent [19]

Blair

[11] Patent Number: 5,155,308

[45] Date of Patent: Oct. 13, 1992

[54] INCLINATION SENSITIVE SWITCH

[75] Inventor: Carl D. Blair, Freeport, Ill.

[73] Assignee: Honeywell Inc., Minneapolis, Minn.

[21] Appl. No.: 720,134

[22] Filed: Jun. 24, 1991

[51] Int. Cl.[5] ..... H01H 35/02

[52] U.S. Cl. ..... 200/61.52

[58] Field of Search ..... 200/61.45 R, 61.45 M, 200/61.52, 61.53, 85 R, DIG. 29; 337/2

[56] References Cited

U.S. PATENT DOCUMENTS

| | | | |
|---|---|---|---|
| 1,393,312 | 10/1921 | Perry | 200/DIG. 29 |
| 2,487,433 | 11/1949 | Gardenhour | 200/DIG. 29 |
| 3,753,474 | 8/1973 | Dillmann | 200/61.52 X |
| 3,769,472 | 10/1973 | Bell et al. | 200/61.45 R |
| 3,886,339 | 5/1975 | Jubenville et al. | 200/61.45 M |
| 4,104,492 | 8/1978 | Pliml, Jr. | 200/61.52 X |
| 4,135,067 | 1/1979 | Bitko | 200/61.52 |
| 4,297,683 | 10/1981 | Roberts | 340/539 |
| 4,628,160 | 12/1986 | Canevari | 200/61.45 R |
| 4,697,174 | 9/1987 | Viator, Sr. | 340/689 |
| 4,789,922 | 12/1988 | Cheshire | 200/61.52 X |
| 4,833,281 | 5/1989 | Maples | 200/61.45 R |
| 4,998,085 | 3/1991 | Johnson | 337/2 |
| 5,002,000 | 3/1991 | Rutter | 200/61.52 X |

*Primary Examiner*—J. R. Scott
*Attorney, Agent, or Firm*—William D. Lanyi

[57] ABSTRACT

An inclination sensitive switch is provided which incorporates a support member that has a device attached to it which can serve as a fulcrum point. A lever is supported by the support member at the fulcrum point in such a way that the lever can operate as a pivotal beam which is rotatable about the fulcrum point. A weight is disposed on the lever and supported by the lever. The weight is moveable along the linear distance of the lever. At least one pair of contacts is provided wherein one conductor of the contacts is attached to the lever and another conductor of the pair of contacts is attached to the support member. Movement of the lever with respect to the support member causes disengagement and engagement of the two conductors. As the support member changes its angular relationship to a reference plane, the angle between the lever and the reference plane is also changed if the angular relationship between the support member and the reference plane reaches a sufficient magnitude. Movement of the lever with respect to a horizontal plane causes a weight to move along the length of the lever and rotate the lever about the fulcrum point under the influence of gravity. This movement about the fulcrum point by the lever moves two conductors into contact with each other and completes a circuit. Movement in the opposite direction about the fulcrum point by the lever causes the conductors to move out of contact with each other.

13 Claims, 5 Drawing Sheets

R
A
G
16
36
20
21
24
25
14
34
θ
Φ
12
10
β
30

INCLINATION SENSITIVE SWITCH

BACKGROUND OF THE INVENTION

1. Field of the Invention

The present invention is generally related to switches which are activated and deactivated in response to changes in the inclination of the switch and, more particularly, to a tilt switch that incorporates a fulcrum and lever system with a movable weight disposed on the lever.

2. Description of the Prior Art

Many different types of tilt switches are known to those skilled in the art. Perhaps the most well known is the mercury tilt switch which utilizes a globule of mercury in a sealed vial which, when tilted, causes the mercury to move from one end of the vial to the other and to conductively bridge two conductors which are disposed within the vial.

Bitko U.S. Pat. No. 4,135,067, issued on Jan. 16, 1979, discloses a tilt switch which is omnidirectional and which includes an enclosure for a gravity response conductive ball. It provides an annular shelf that surrounds a central depression where at least one switch contact passes into the housing and is exposed. In response to the tilting of this switch, a ball is moveable away from a cup shaped housing to the depression where it engages the contact and closes a circuit between that contact and another contact. This particular device incorporates a globule of a conductive liquid, such as mercury, within its housing for the purpose of conductively bridging the two contacts.

Roberts U.S. Pat. No. 4,297,683, which issued on Oct. 27, 1981, describes an alarm system for parking meters. The unauthorized entry into a portion of the device, such as the parking meter, utilizes a radio transmitter which is adapted to send two signals simultaneously to a receiver that is constantly energized. A switch is actuated when the supporting post of the parking meter is bent and a timer is placed in the circuit so that only after a determined interval of time a signal is sent which indicates the bent post. This device utilizes a rolling member, such as a sphere, inclosed in a housing.

Maples U.S. Pat. No. 4,833,281, which issued on May 23, 1989, discloses a motion detector that is particularly applicable for use with a transmitter in motor vehicle keyless entry system. The motion detector includes a spool surrounded by and electrically insulated from a shell. A sphere is positioned in the annular cavity around the spool. Changes of state of the motion detector occur when the ball moves into and out of direct contact with the spool or shell and further as the ball rolls around the annular cavity while being supported by both the spool and shell caused by surface roughness of the interface surfaces.

Cheshire U.S. Pat. No. 4,789,922, which issued on Dec. 6, 1988, describes an earthquake safety light which utilizes a weighted object which is displace on the occurrence of an earthquake of a given preset magnitude and, when it is displaced, it closes a circuit which activates an emergency light so that occupants in the surrounding area may see the light and be guided by it.

Viator U.S. Pat. No. 4,697,174, which issued on Sep. 29, 1987, discloses a ball actuated alarm device that provides a warning at the initiation of catastrophic tilting of a device such as an offshore platform. The alarm device utilizes a free rolling ball member on a normally horizontal planar surface. The surface is divided into regions by elongated protuberances which separate the ball from a switch that is capable of being closed by contact with the ball.

Canevari U.S. Pat. No. 4,628,160, which issued on Dec. 9, 1986, describes an electrical tilt switch that comprises a cylindrical cap member with a hollow interior and an internally extending ridge positioned a significant distance above its lower edge. It also comprises a spherical contact member that is carried on a dished surface and movable against the ridge when the switch is tilted to a specified angle. For severe environmental conditions, the preferred material for the cap, the base and the spherical contact member is a Monel alloy.

Several problems exist with regard to tilt switches known to those skilled in the art. First, the switches which utilize a conductive globule of liquid sometimes require particular care in their use. Furthermore, switches which incorporate a conductive rolling sphere which makes electrical contact with two conductors and provides an electrical bridge between those conductors are sometimes limited in application to currents below a certain magnitude. If the switch is required to be responsive to very small degrees of inclination, pitting of the sphere's surface inhibit the sphere from rolling at extremely low angles of inclination. The pitting forms numerous marks on the sphere's surface as a result of electrical arcing when contact is being made or broken between the electrical conductors and the sphere These small defects to the smoothness of the sphere surface can inhibit the smooth rolling of the sphere and, under some conditions, prevent the sphere from initiating its rolling movement on a track when the required angle of inclination exits.

Another severe problem which exists in most tilt switches that incorporate a rolling member is that the force that is available to make and break an electrical contact is generally only a small fraction of the weight of the sphere. In some applications, it is desirable to close electrical contacts and hold them together with a force that is equal to o greater than the weight of the sphere. Conversely, it is also desirable to have a force available to break the contacts (in case of welding or sticking) that is equal to or greater than the weight of the sphere. It is also desirable to provide an inclination sensitive switch which does not use the surface of the sphere as an electrical contact and, therefore, eliminates the possibility of pitting and failure of the switch due to the defects in the spherical surface caused by that pitting.

SUMMARY OF THE INVENTION

The present invention is directed to providing solutions to the above described problems by utilizing a rolling spherical member which rolls back and forth on a lever beam which, in turn, is supported at a fulcrum point. When the ball moves to one extreme end of the lever, its weight is used to move the lever to a position which causes one contact to move into electrical communication with another. In a preferred embodiment of the present invention, the contacts are positioned both at a point on the lever and a point on a support member which magnifies the force caused by the weight of the ball as a result of the mechanical advantage provided by the relative lengths of the moment arm of the ball position and the switch position relative to the fulcrum point In a preferred embodiment of the present invention, a tilt switch comprises a support member that is moveable in angular relation to a reference plane in response to a stimulus. In addition, a lever is connected in pivotal relation with the support member and a weight is associated in moveable relation with the lever along a generally linear path relative to the lever in response to the force of gravity. In a most preferred embodiment of the present invention, the weight comprises a sphere which is positioned to roll along the length of the lever. An electrical contact is actuated by movement of the lever relative to the support member in a first direction and is deactivated by movement of the lever relative to the support member in a second direction. The lever is connected to the support member at a fulcrum point and the electrical contact is disposed at a midpoint between the fulcrum point and a point of maximum travel of the weight along the lever in a particularly preferred embodiment of the present invention.

In a preferred embodiment of the present invention, the support member is generally tubular in shape and the lever is disposed within the generally tubular support member. The electrical contact comprises a pair of electrical conductors with one of the conductors being connected to the support member and a second on of the conductors being connected to the lever. Although it is expected that the stimulus described above will usually be a change in temperature, it should be understood that the present invention is applicable in many other types of applications. When utilized to detect a change in temperature, the support member of the present invention can be attached to a device which moves in response to temperature change, such as a bimetal structure.

BRIEF DESCRIPTION OF THE DRAWING

The present invention will be more fully understood from a reading of the Description of the Preferred Embodiment in conjunction with the drawing, in which.

DESCRIPTION OF THE PREFERRED EMBODIMENT

Figure 1:
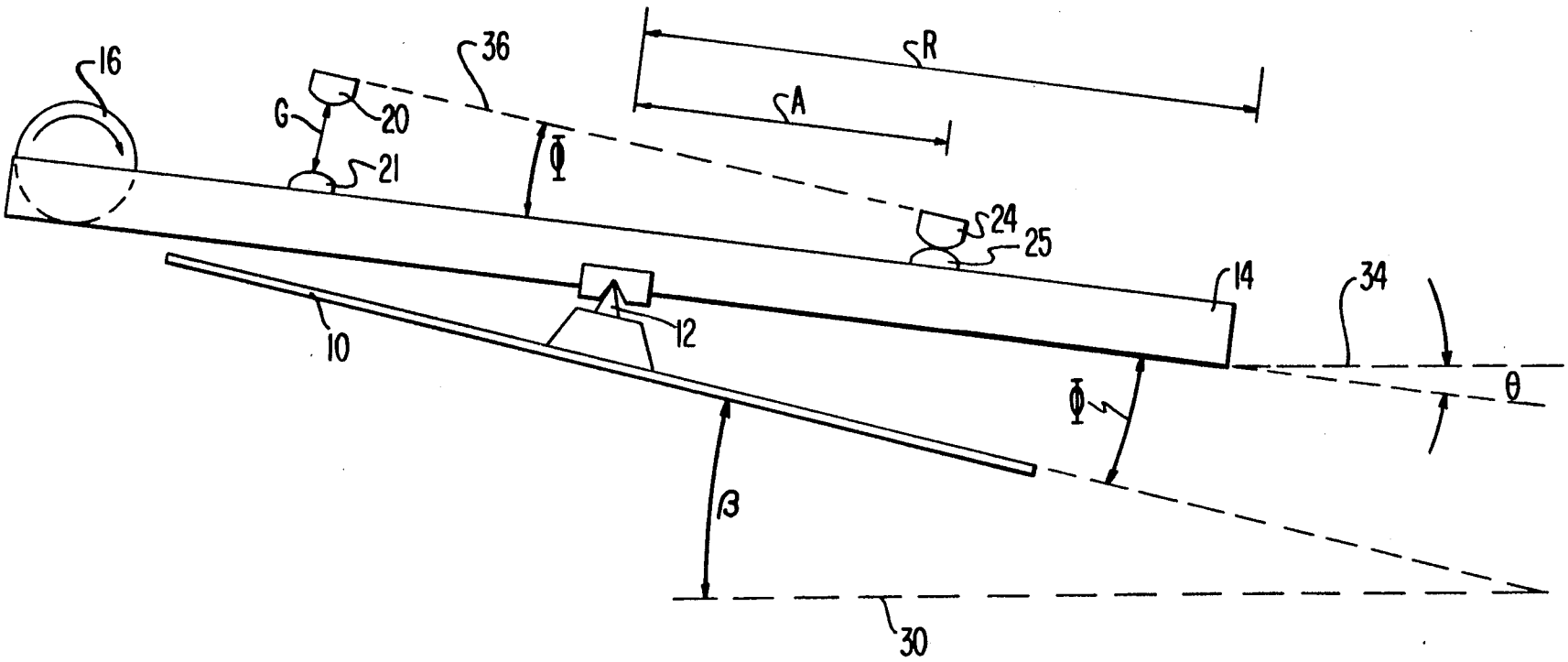
FIG. 1 illustrates a schematic representation of the present invention.

Throughout the description of the preferred embodiment, like components will be identified with like reference numerals. In FIG. 1, a support member 10 is provided with a device 12 that is operable as a fulcrum point. A lever 14, which is shaped to form a trough such as a V-shaped through, is disposed in the support relation on the fulcrum point 12 of the support member 10. The association of the lever 14 and the fulcrum point 12 is such that a generally balanced relationship exists between the support member 10 and the lever 14 unless an external force is exerted against either of the two components.

A weight 16 is disposed in the trough-like portion of the lever 14 as shown in FIG. 1. Suitable end structures are provided at each end of the lever 14 to prevent the weight 16 from moving beyond the ends of the lever. In a preferred embodiment of the present invention, the weight 16 is a sphere disposed in the V-shaped lever 14 in a manner which permits the sphere to roll back and forth from one end of the lever 14 to the other in response to the forces of gravity.

As can be seen in FIG. 1, movement of the weight 16 to the far left portion of the lever 14 will cause the lever to move in a counterclockwise direction about the fulcrum point 12 until it meets some obstruction which prevents further rotation about the fulcrum point. Similarly, movement of the weight 16 toward the extreme right end of the lever 14 will cause the lever to pivot about the fulcrum point 12 in a clockwise direction until the lever 14 meets some obstruction which prevents further rotation.

Also shown in FIG. 1 are two pairs of contacts. The first pair of contacts, identified by reference numerals 20 and 21, are 10 shown in a disconnected, or separated, state in FIG. 1. A second pair of contacts, identified by reference numerals 24 and 25 in FIG. 1, are shown in contact with each other. It must be clearly understood that conductors 20 and 24 are connected to the support member 10 or to a structure that is attached to the support member 10. In other words, they move in conformance with movement of the support member 10. On the other hand, contacts 21 and 25 are attached to the lever 14 and move in conformance with its movement. FIG. 1 is a highly schematic representation intended for use in describing the physical movement and interrelationship of the relevant parts of the present invention. Therefore, it should be clearly understood that the representation in FIG. 1 is not intended to resemble the physical appearance of the present invention but, instead, is intended only to show the relative movement and geometric relationship between components of the present invention during operation. For example, a preferred embodiment of the present invention would not dispose contacts 20 and 24 at a position above the lever 14 although that type of disposition of contacts 20 and 24 is completely within the scope of the present invention. The position of the four contacts shown in FIG. 1 is intended to facilitate the description of the operation of the present invention and not to represent its precise physical appearance. The appearance of the preferred embodiment of the present invention will be described in much greater detail in association with FIGS. 5–7 below.

In FIG. 1, it can be seen that the support member 10 is disposed at an angle $\beta$ (beta) relative to a predefined reference plane 30. Reference plane 30 is represented by a dashed line in FIG. 1 because the reference plane 30 is perpendicular to the surface of the drawing of FIG. 1. In addition, angle $\Phi$ (phi) represents the angular relationship between the support member 10 and lever 14. The angle between lever 14 and a predefined reference plane 34 is identified as angle $\theta$ (theta) in FIG. 1. It should be understood that reference planes 30 and 34 are parallel to each other and, in a typical application of the present invention, are disposed in horizontal planes.

As can also be seen in FIG. 1, movement of the lever 14 about the fulcrum point 12 in a counterclockwise direction causes contacts 24 and 25 to move into electrical communication with each other. Similarly, it should also be seen that contact between conductors 24 and 25 serves to inhibit further rotation of the lever 14 about the fulcrum point 12. If the lever 14 rotates in an opposite, or clockwise, direction about the fulcrum point 12, conductors 20 and 21 will move toward each other and into electrical communication with each other and stop further rotation in that direction.

With continued reference to FIG. 1, it should be understood that dashed line 36 is intended to represent the fact that conductors 20 and 24 are stationary with respect to each other and also with respect to the support member 10. If the support member 10 is disposed parallel to reference plane 30 (i.e. angle $\beta=0$ degrees), and the weight 16 is located at the extreme left end of the lever 14, conductors 24 and 25 will be in contact with each other and conductors 20 and 21 will be spaced apart by a distance represented by the letter G which represents the gap between the disengaged conductors. As the angle $\beta$ between the support member 10 and the reference plane 30 increases, the relationship between conductors 24 and 25 will cause the lever 14 to also move in a clockwise direction, thus increasing the magnitude of angle $\beta$. Eventually, the weight 16 will move toward the right under the influence of gravity and, when it passes the fulcrum point 12, will begin to cause the lever 14 to move in a clockwise direction about fulcrum point 12. When the weight 16 moves past fulcrum point 12 in its path toward the right end of the lever 14, it will eventually cause the lever 14 to move in a clockwise direction and move conductor 21 into contact with conductor 20 while disengaging conductors 24 and 25 from electrical communication with each other. Thus, the engaging and disengaging of the contacts results from the angular movement of the lever 14 which, in turn, is responsive to the angular movement of the support member 10.

With continued reference to FIG. 1, it should be noted that the distance between the fulcrum point 12 and the extreme position of the weight at one end of the lever 14 is identified as distance R and the distance between the fulcrum point 12 and position of the conductor 25 is identified as distance A. By determining the relative magnitudes of distances R and A, the mechanical advantage of the device can be determined. For example, if R is twice the magnitude of A and the device is symmetrical about point 12, movement of weight 16 to the right end of the lever 14 will result in force between conductors 2 and 21 which is equivalent to approximately twice the weight of the sphere. As a result of this mechanical advantage, also, that movement of the weight 16 will initially use that mechanical advantage to separate conductors 24 and 25. In other words, movement of the weight along the lever 14 will first break contact between one set of conductors (in this case conductors 24 and 25) and then, because of its break before make characteristic, it causes conductors 20 and 21 to move into contact with each other. During both of these sequential occurrences, the mechanical advantage provided by the present invention is utilized to aid in both the breaking of contacts and making of contacts. Therefore, a two ounce weight 16 can result in a contact force between conductors and weld breaking force between conductors which is equivalent to approximately four ounces. It should be apparent that appropriate positioning of the components to determine the magnitudes of distances of R and A can result in very significant mechanical advantages and weight multipliers. The position of the conductors with respect to the lever 14 is also a function of the desired gap G between conductors when they are disconnected. Obviously, movement of the conductors toward the fulcrum point will minimize the total gap between conductors when they are disengaged. Movement of the conductors away from the fulcrum point 12 will maximize the gap while reducing the mechanical advantage of the device as a force magnifier. It should also be noted that the position of the conductors 20–25 relative to both the lever 14 and the support member 10 will determine the maximum magnitude of angle $\Phi$. Furthermore, since angle is equal to the sum of angles $\beta$ and $\Phi$, the magnitude of angle will determine the magnitude of angle $\theta$ as a function of angle $\beta$. In other words, in order to obtain a certain angle of inclination of the lever 14, which is identified as angle $\theta$, a certain angle $\beta$ between the support member 10 and a reference plane 30 will be required to be greater than angle $\theta$ by a magnitude equivalent to angle $\Phi$.

Figure 2:
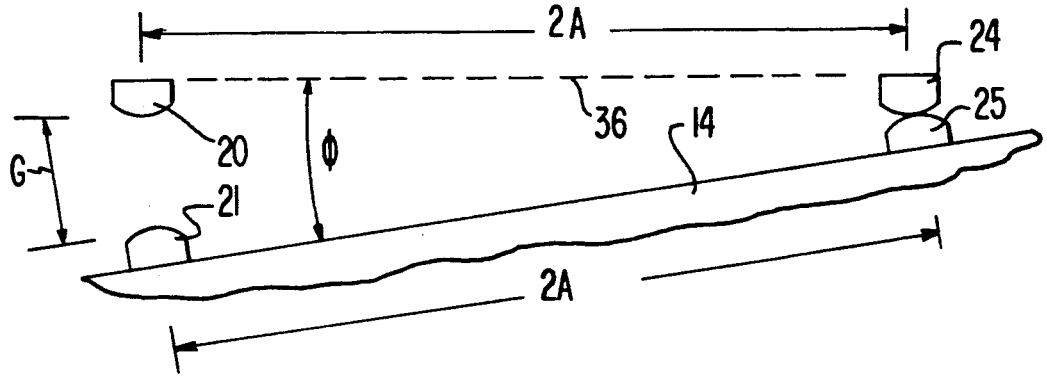
FIG. 2 is a partial view of the device in FIG. 1.

With reference to FIG. 2, it can be seen that the magnitude of gap G is a function of angle $\Phi$ and the distance between the conductors, which is twice the magnitude of distance A in FIG. 1. Therefore, it can be seen that the magnitude of distance G is defined by the equation $$G=4A\sin(\Phi/2)$$

where the angle $\Phi$ is the included angle between dashed line 36 and the lever 14 and dimension A is the same as that described above in conjunction with FIG. 1. The relationship discussed above indicates that the magnitude of angle G is a function of the same variables which determine the mechanical advantage of the device shown in FIG. 1.

Figure 3:
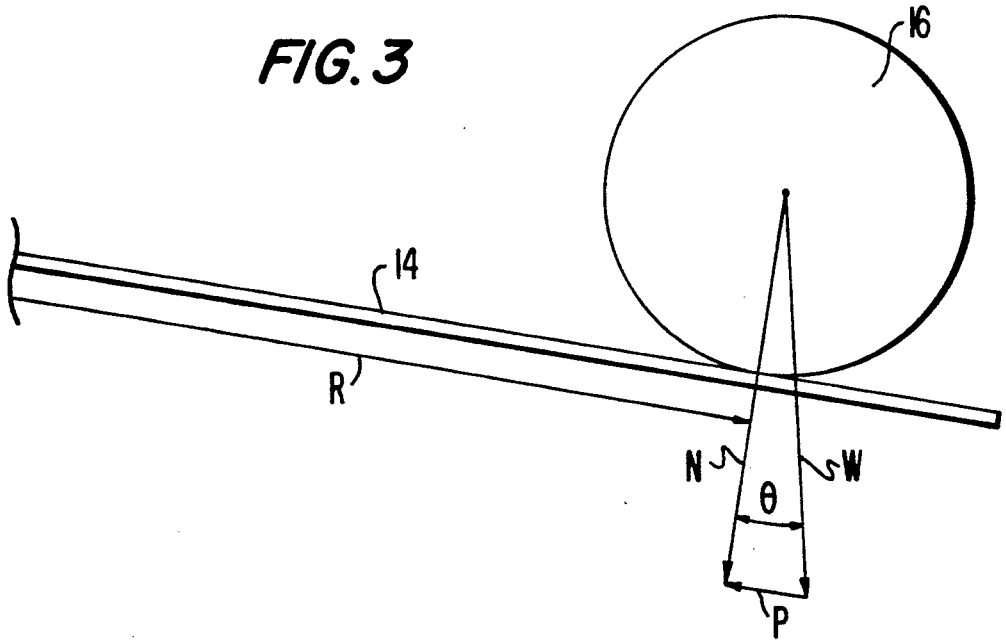
FIG. 3 is a diagram used to describe the force vectors related to the present invention.

FIG. 3 is a schematic illustration which shows the effective force provided by the weight 16 on the lever 14. The weight of the sphere, which is indicated by vector W in FIG. 3 is directly vertical. Vector N represents the force which is perpendicular to the lever 14 and vector P is the vectorial difference between vectors W and N. As shown in FIG. 3, the normal vector N operates at a distance R from the fulcrum point and results in a force equal to $W\cos(\theta)$ that operates at a moment arm equal to R about fulcrum point 12. Since angle $\theta$ is expected to be relatively small in a preferred embodiment of the present invention and is equal to the angle necessary to cause the weight 16 to move in a rolling manner along the lever 14, vector N is only slightly less than vector W which represents the full weight of the sphere. Therefore, the present invention provides a system which utilizes virtually all of the force available from the weight 16. As described above, that force represented by vector N is multiplied by the relative magnitudes of distances R and A as shown in FIG. 1.

If the present invention is intended for use as a switch which is responsive to a change in temperature, the support member 10 would be attached to some mechanism which is sensitive to temperature change. In this type of application, the arrangement would be similar to that used in the well known mercury switch in a thermostat. For example, a bimetal can be used to cause, by its movement in response to temperature change, a movement of the support member 10 relative to a reference plane 30. That movement, in turn, would cause an angular movement of the lever 14 if angle is sufficient to cause angle $\theta$ to surpass the required inclination necessary to induce movement of the weight 16 along the length of lever 14. It should be clearly understood, however, that the present invention is not limited to use in switches that are temperature sensitive. Any switch which is necessarily responsive to movement of a device can be provided by the present invention.

Figure 4A:
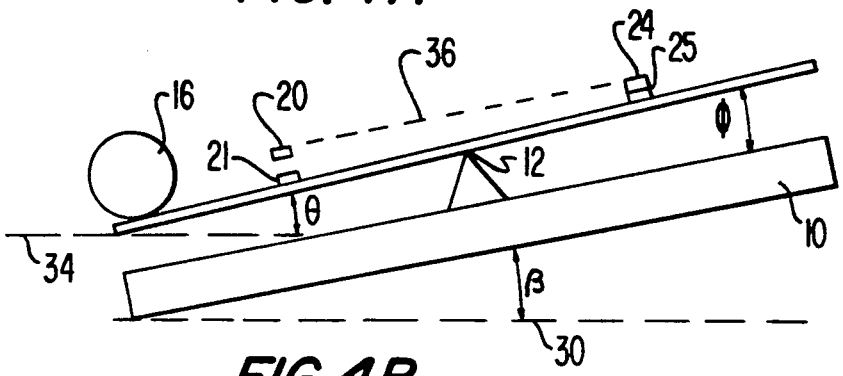
FIG. 4A–4C illustrate the mechanical operation of the preferred embodiment of the present invention as sequential steps.
Figure 4B:
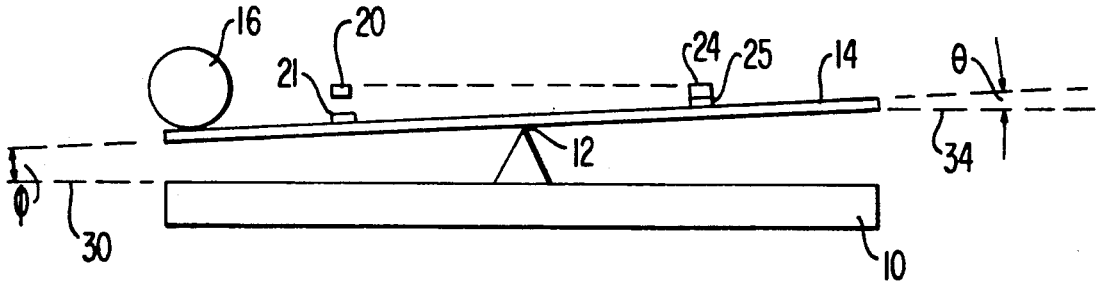

FIGS. 4A–4B illustrate the sequential operation of the present invention as it moves from one angle of inclination to another. In FIG. 4A, the weight 16, which is a spherical ball, is disposed at the left most end of the lever 14 and the lever 14 is rotated about it's fulcrum point 12 in a counterclockwise direction so that conductors 20 and 21 are separated while conductors 24 and 25 are in electrical contact with each other. It should be understood that FIG. 4A–4D are shown in an extremely schematic manner for the purpose of describing the physical operation of the present invention and not for the purpose of describing the physical appearance of the particular components used in a preferred embodiment of the present invention. That physical structure preferred embodiment will be described below in conjunction with FIGS. 5–7.

In FIG. 4A, the device is shown at one extreme end of travel where the supporting means 10 is inclined at its most counterclockwise position. As described above, dashed line 36 represents the fact that conductors 20 and 24 are attached to the supporting means 10 and rotate with the supporting means.

In FIG. 4B, the supporting means 10 is shown as being rotated in a clockwise direction from its position in FIG. 4 A. This can be recognized by the fact that reference plane 30 represents a horizontal plane which is generally parallel to reference plane 34. In FIG. 4B, the supporting means 10 is disposed parallel to reference plane 30 while supporting means 10 is disposed at angle $\Phi$ to reference plane 30 in FIG. 4A. Because of the operation of the lever 14 in association with the fulcrum point 12, the movement of the supporting means to the position shown in FIG. 4B does not operate to disconnect conductors 24 and 25 from each other because of the fact that weight 16 is disposed at the leftmost side of the lever 14 and maintains its biased position with conductors 24 and 25 in contact with each other.

As the supporting means 10 continues to rotate in a clockwise direction, the lever 14 will reach an angle that will induce the weight to begin to roll toward the right from the position shown in FIG. 4B. At this point, both conductors 20 and 21 and conductors 24 and 25 are momentarily disconnected from each other. It should be understood that although the present invention has been described in terms of two sets of contacts, alternative embodiments of the present invention could incorporate a single set of contacts.

Figure 4C:
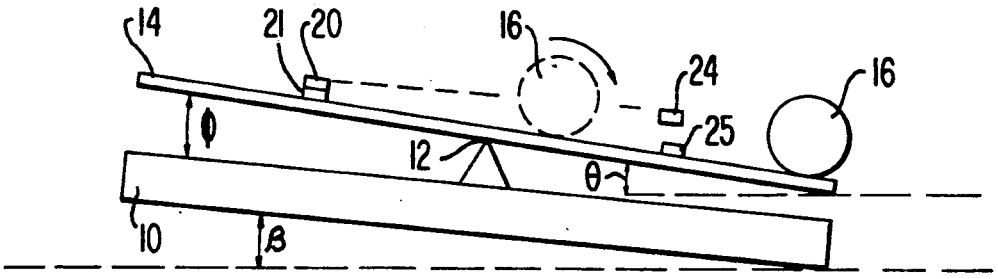

FIG. 4C shows the present invention in a situation that is opposite to that shown in FIG. 4A. The weight 16 has moved to a position at the extreme right end of the device, as represented by the solid line, from an intermediate position rolling along the lever 14, as illustrated by the dashed line representation. The lever 14 has moved to an extreme clockwise position relative to the supporting means 10 and conductors 20 and 21 have moved into contact with each other while conductors 24 and 25 remain separated. Although FIG. 4A–4C are illustrated in an extremely schematic manner, it should be understood that those figures are intended to show the sequential and relative operation of the supporting means 10 and the lever 14. These figures are also intended to show the operation of the total operation which first induces the rolling of the weight 16 along the lever and then reacts to that rolling weight by causing the lever 14 to pivot about the fulcrum point 12.

Figure 5:
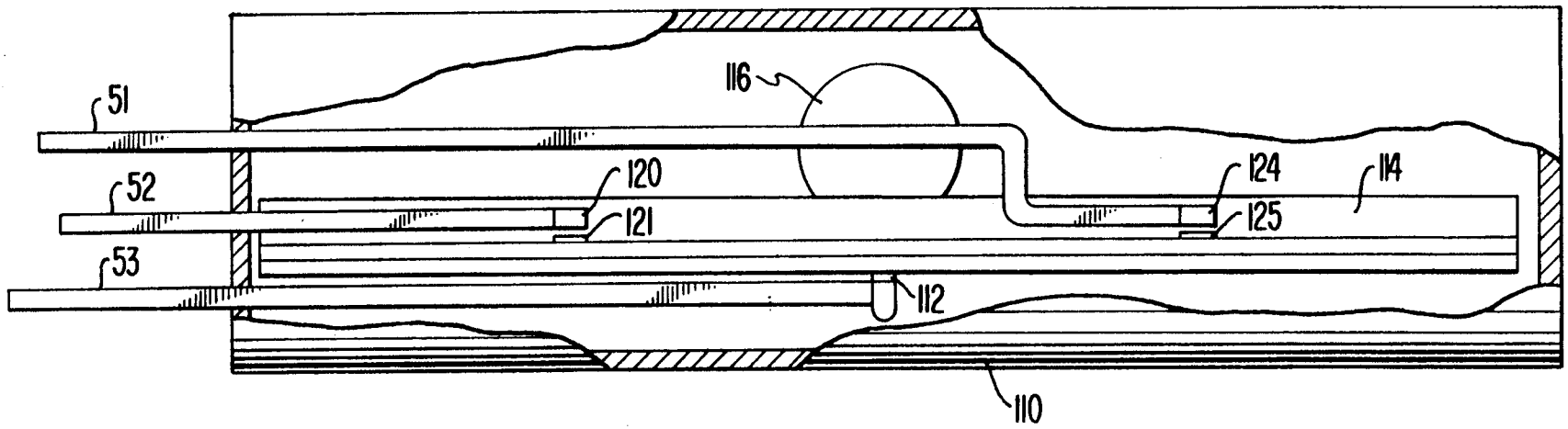
FIG. 5 shows a preferred embodiment of the present invention disposed within a tubular containment.

FIG. 5 shows a preferred embodiment of the present invention. Three leads, 51, 52 and 53 extend from points outside a housing structure 110 into the housing structure to provide electrical communication between an external circuit and the contacts of the present invention. As can be seen, lead 51 is connected in electrical communication with conductor 124 while lead 52 is connected in electrical communication with conductor 120. These two conductors are arranged to be associated in electrical communication with conductors 125 and 121, respectively. Conductors 121 and 125 are attached to the lever 114 which, in this preferred embodiment of the present invention, is a trough which is generally triangular in cross section and shaped to support a spherical weight 116 in rolling association thereon. The lever is supported at a fulcrum point 112 which is also connected in electrical communication with lead 53. If the lever 114 is electrically conductive, it's contact with the fulcrum point 110 will conduct electricity from lead 53, through fulcrum point 112 and lever 114, to conductors 121 and 125. Therefore, as can be seen in FIG. 5, electrical communication can be maintained from lead 53 to lead 52 if the lever 114 is rotated about fulcrum point 112 in a clockwise direction to place conductors 120 and 121 in contact with each other. Similarly, electrical communication can be maintained from lead 53 to lead 51 if lever 114 is rotated in a counterclockwise direction about fulcrum point 112 to place conductor 124 in contact with conductor 125. As described above, this alternating contact arrangement is caused by the position of the spherical weight 116 on the lever 114.

Figure 6:
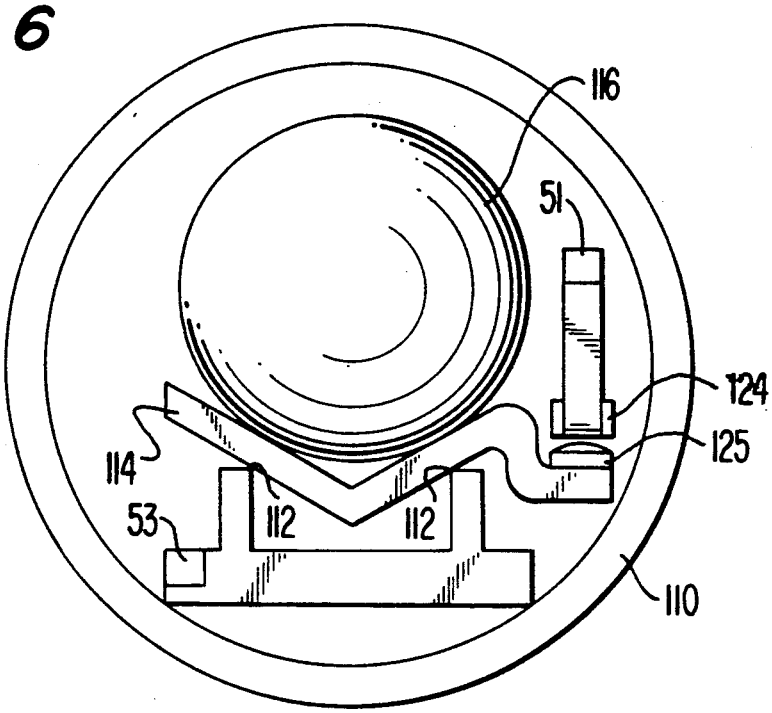
FIG. 6 shows an end view of the device illustrated in FIG. 5.

With reference to FIG. 6, it can be seen that the present invention is disposed in the housing 110 which also operates as a supporting means to fulfill the function described above in association with reference numeral 10. In FIG. 6, the supporting means, or housing 110, supports a fulcrum device that provides the fulcrum point 112. As can be seen in FIG. 6, the lever 114 is actually supported at two fulcrum points 112 which are aligned with each other. The fulcrum device is connected in electrical communication with the lead 53. This enables the electrical current to pass from lead 53, through the fulcrum device, to the lever 114 and the conductor 125 to lead 51 when conductor 124 is in electrical contact with conductor 125. The tubular structure identified by reference numeral 110 operates as a supporting means in cooperation with the lead 53 and the fulcrum device that provides the two fulcrum points 112. Although shown as a separate component in FIG. 6, it should be understood that during operation of the present invention, the fulcrum device is identical in movement and reaction to the tubular supporting means 110.

Figure 7:
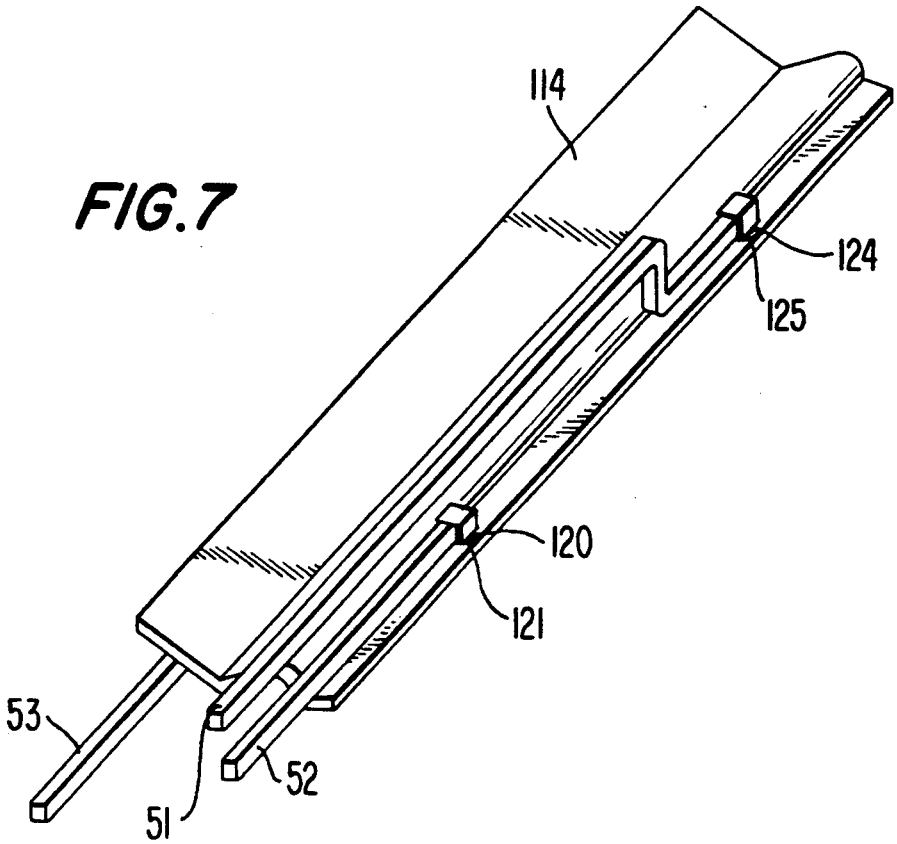
FIG. 7 illustrates a perspective view of the present invention.

FIG. 7 is a perspective view which illustrates the present invention without the tubular structure 110. As shown in FIG. 7, the lever 114 is a trough which is generally V-shaped in cross-section. Although no end stops are shown in the figures, it should be understood that some means is provided to stop the rolling weight 116 when it reaches the ends of the lever 114. The lever is attached to conductors 121 and 125 and, by pivoting about its fulcrum point 112, the lever 114 moves one of its conductors, 121 or 125, into contact with an associated conductor, 120 or 124, which is attached to one of the leads, 51 or 52. That completes the circuit and connects either of the two leads, 51 or 52, in electrical communication with lead 53 which is connected to the fulcrum base and the lever 114.

Although the present invention has been described in great detail and has been illustrated to shown a particular preferred embodiment, it should be understood that many alternative embodiments are within the scope of the present invention.

The embodiments of the invention in which an exclusive property or right is claimed or defined as follows:

1. A tilt switch, comprising:

a support member;

a lever connected in pivotal relation with said support member at a fulcrum;

a weight associated in movable contact relation with aid lever along a generally linear path, in response to the force of gravity, between said fulcrum point and a point of maximum travel of said weight;

a first conductor attached to said lever at a point between said fulcrum and said point of maximum travel;

a second conductor attached to said support member, said first and second conductors being movable into contact with each other in response to movement of said lever in a first arcuate direction relative to said fulcrum, said first and second conductors being movable out of contact with each other in response to movement of said lever in a second arcuate direction relative to said fulcrum.

2. The switch of claim 1, wherein:

said weight is a spherical ball.

3. The switch of claim 1 wherein:

said support member is generally tubular and said lever is disposed within said generally tubular support member.

4. The tilt switch of claim 1, wherein:

said first conductor is attached to said lever at a midpoint between said fulcrum and said point of maximum travel.

5. A switch, comprising:

a support member;

a pivot member connected to said support member at a fulcrum point, said pivot member being rotatable about said fulcrum point;

a weight, said weight being supported by said pivot member, said weight being movable along said pivot member in response to movement of said support member relative to a horizontal plane; and a pair of conductors, said pair of conductors being movable into electrical communication with each other in response to movement of said pivot member, a first conductor of said pair of conductors being attached to said pivot member between said fulcrum point and a point of maximum travel away from said fulcrum point of said weight, a second conductor of said pair of conductors being attached to said support member, said first and second conductors being equidistant from said fulcrum point.

6. The switch of claim 5, wherein:

said weight is a solid device.

7. The switch of claim 5, wherein:

said weight is a sphere.

8. The switch of claim 5, wherein:

said support member is tubular, said pivot member being disposed within said tubular support member.

9. The switch of claim 5, wherein:

said weight comprises two spheres disposed in rolling association with said pivot member.

10. The switch of claim 5, wherein:

said pivot member is shaped to form a trough and said weight is a sphere disposed in said trough for movement along said pivot member to either side of said fulcrum point in response to changes in angular relation of said support member to said horizontal plane.

11. A switch, comprising:

a support member;

a pivot member connected to said support member at a fulcrum point, said pivot member being rotatable about said fulcrum point;

a weight disposed on said pivot member, said weight being movable in relation to said pivot member between said fulcrum point and a point of maximum travel of said weight away from said fulcrum point, said pivot member being movable about said fulcrum point in response to movement of said weight relative to said pivot member; and a pair of conductors, each of said pair of conductors being movable into contact with each other in response to rotation of said pivot member about said fulcrum point, a first conductor of said pair of conductors being attached to said pivot member at a point between said fulcrum point and said point of maximum travel, a second conductor of said pair of conductors being attached to said support member, said first and second conductors being generally equidistant from said fulcrum point.

12. The switch of claim 11, wherein:

said weight is a sphere.

13. The switch of claim 11, wherein:

said support member is generally tubular, said pivot member being disposed within said generally tubular support member;

said pivot member is shaped to define a trough; and said weight is a sphere disposed in rolling association in said trough.

* * * * *